US006464550B2

(12) United States Patent
Lee

(10) Patent No.: US 6,464,550 B2
(45) **Date of Patent: *Oct. 15, 2002**

(54) METHODS OF FORMING FIELD EMISSION DISPLAY BACKPLATES

(75) Inventor: Ji Ung Lee, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/838,845

(22) Filed: Apr. 20, 2001

(65) Prior Publication Data

US 2002/0021069 A1 Feb. 21, 2002

Related U.S. Application Data

(62) Division of application No. 09/244,558, filed on Feb. 3, 1999.

(51) Int. Cl.[7] ..... H01J 9/02
(52) U.S. Cl. ..... 445/24; 438/20
(58) Field of Search ..... 438/20; 445/24, 445/50

(56) References Cited

U.S. PATENT DOCUMENTS

| | | | | |
|---|---|---|---|---|
| 4,513,308 A | | 4/1985 | Greene et al. | |
| 5,229,331 A | | 7/1993 | Doan et al. | |
| 5,391,259 A | * | 2/1995 | Cathey et al. | 445/50 |
| 5,576,594 A | | 11/1996 | Toyoda et al. | |
| 5,710,478 A | | 1/1998 | Kanemaru et al. | |
| 5,818,153 A | * | 10/1998 | Allen | 438/20 |
| 5,990,612 A | | 11/1999 | Konuma | |
| 6,022,256 A | * | 2/2000 | Rolfson | 445/24 |
| 6,130,106 A | * | 10/2000 | Zimlich | 438/20 |
| 6,137,219 A | | 10/2000 | Song et al. | |

OTHER PUBLICATIONS

S. Wolf; Silicon Processing for th eVLSI Era—vol. II, 1990; pp. 104–105.

* cited by examiner

*Primary Examiner*—Kenneth J. Ramsey
(74) *Attorney, Agent, or Firm*—Wells St. John, P.S.

(57) ABSTRACT

The present invention includes field emission display backplates and methods of forming field emission display backplates. According to one aspect, the present invention provides a field emission display backplate including a substrate having a surface; an emitter which extends from the surface of the substrate; and an anode having an upper surface, a lower surface, and an opening surface which defines an opening aligned with the emitter, the opening surface includes a first portion which curves outward relative to the anode and a second portion which curves inward relative to the anode.

19 Claims, 5 Drawing Sheets

METHODS OF FORMING FIELD EMISSION DISPLAY BACKPLATES

RELATED PATENT DATA

This patent resulted from a divisional application of U.S. patent application Ser. No. 09/244,558, filed Feb. 3, 1999, entitled "Field Emission Display Backplates (As Amended) ", naming Ji Ung Lee as inventor and the disclosure of which is incorporated by reference.

PATENT RIGHTS STATEMENT

This invention was made with government support under contract No. DABT63-97-C-0001 awarded by Advanced Research Projects Agency (ARPA). The Government has certain rights in this invention.

TECHNICAL FIELD

The present invention relates to field emission display backplates and methods of forming field emission display backplates.

BACKGROUND OF THE INVENTION

Field emission displays are utilized in a growing number of applications. Some conventional field emission display configurations include a cathode plate, also referred to as a backplate, having a series of emitter tips fabricated thereon. The emitters are configured to selectively emit electrons toward an opposing screen of a faceplate to produce an image. Such a screen is typically coated with a phosphor to produce an image responsive to emitted electrons striking the screen.

Multiple emitters are typically utilized to excite a single pixel. For example, hundreds of emitters may be utilized for a single pixel. Individual pixels can contain a deposited one of red, green or blue phosphor.

A grid, also commonly referred to as a gate, comprising a conductive material such as metal or polysilicon is preferably formed adjacent and spaced from the emitter tips. The gate is preferably positively charged providing an anode to selectively control the emission of electrons from a corresponding emitter. Inasmuch as the substrate is usually grounded or provided at a lower voltage potential, the selective application of a positive voltage to the gate results in the selective emission of electrons from the corresponding emitter. Further, the corresponding screen of the faceplate may be positively charged to attract emitted electrons. An exemplary field emission display configuration is described in U.S. Pat. No. 5,229,331, assigned to the assignee of the present invention, and incorporated herein by reference.

It has been observed during operation of conventional field emission displays that undesired or spurious electron emission from the emitter to the grid or gate electrode can occur. Such emitted electrons proceed in a substantially horizontal path and are drawn to the gate electrode as opposed to being drawn to the phosphor screen of the faceplate as desired.

Referring to FIG. 1*a*–FIG. 1*c,* a process for fabricating an emitter and grid construction of a conventional field emission display backplate fragment 10 is illustrated. Referring specifically to FIG. 1*a,* fragment 10 includes a bulk substrate 12. Substrate 12 comprises a monocrystalline silicon wafer, or polysilicon or amorphous silicon on a glass substrate. A layer of first material 13 and a layer of second material 14 are formed within bulk substrate 12. The first and second layers can be doped with impurities to provide p− semiconductive material 13 and n+ semiconductive material 14, respectively. A mask 9 is formed over substrate 12.

Referring to FIG. 1*b*, isotropic and/or anisotropic etching of the structure of FIG. 1*a* provides an emitter 11 which extends from a surface of substrate 12. The etch is timed such that emitter 11 typically comprises substantially n+ semiconductive material 14.

Referring to FIG. 1*c*, a conformal layer of insulative material 18 is deposited over substrate material 13 and emitter 11 following the formation of emitter 11. Thereafter, conductive material 16 having surfaces 17 is formed over the layer of insulative material 18. Field emission display backplate fragment 10 may next undergo chemical-mechanical polishing to remove portions of the conductive material and the conformal insulating material which extends beyond emitter 11 as described in U.S. Pat. No. 5,229,331. The chemical-mechanical polishing step exposes the insulative layer about emitter 11. Wet etching of the insulative layer forms the depicted regions of insulative material 18 and exposes emitter 11.

An electrical field is generated intermediate surfaces 17 of grid 16 and emitter 11 to provide electron emission from emitter 11 through an opening 15 within grid 16. During operation, spurious electrons may be drawn in a substantially horizontal direction towards grid 16 as opposed to a direction through opening 15. Such is undesired. This problem is particularly acute in applications where the spacing intermediate grid surfaces 17 and emitter 11 is reduced to provide a field emission display backplate structure 10 which is operable with lower turn-on voltages.

Referring to FIG. 2, a conventional structure utilized to reduce the emission of spurious electrons from emitter 11 to grid 16*a* is illustrated. More specifically, increasing the spacing intermediate the outer surface of emitter 11 and surfaces 17 of grid 16 reduces the flow of such spurious electrons to grid 16.

Conventional field emission display fragment 10*a* can be formed utilizing a reflow processing step. More specifically, following the formation of the conformal insulative layer, a reflow process step is conducted to reduce the slope of portions of the insulative layer over emitter 11. Thereafter, a conductive layer is deposited over the reflowed insulative layer to form grid 16*a*. Such provides surfaces 17*a* of grid 16*a* having reduced slopes compared with grid surfaces 17 shown in FIG. 1*c* and represented as dashed lines. In particular, the depicted grid 16*a* includes surfaces 17*a* which are pulled back from emitter 11 compared with surfaces 17 of grid 16 of FIG. 1*c*. Fragment 10*a* of FIG. 2 provides reduced spurious electron emission from tip 11 to grid 16*a* compared with the emission of spurious electrons from tip 11 to grid 16 of FIG. 1*c*.

However, the described reflow processing technique of the conformal insulative layer has some disadvantages with respect to field emission display backplate processing. For example, the reflow temperature of the insulative material may exceed the strain point of some glass substrates resulting in damage to the structure. Further, the reflowed insulative layer may have a non-uniform thickness across the substrate because of possible varied temperatures across the substrate during the reflow processing step. Also, reflow processing techniques are often difficult to implement in arrangements having a large number of tips in close proximity to one another because of increased surface tension. Numerous tips are typically provided within field emission display backplates to reduce non-uniform characteristics of individual ones of the tips. In addition, opening 15 formed within grid 16*a* is sensitive to chemical-mechanical polishing inasmuch as grid 16*a* has been pulled back from tips 11.

Therefore, there exists a need to provide improved field emission display backplate structures and processing methodologies of the same which overcome the problems associated with the prior art.

SUMMARY OF THE INVENTION

The present invention includes field emission display backplates and methods of forming field emission display backplates. According to a first aspect, a field emission display backplate includes a substrate having a surface and an emitter which extends from the surface of the substrate. Further, an anode having an upper surface, a lower surface, and an opening surface, is formed spaced from the emitter. The opening surface defines an opening aligned with the emitter and the opening surface includes a first portion which curves outward relative to the anode and a second portion which curves inward relative to the anode.

According to some aspects, the emitter has a surface including an inner surface portion which curves outward relative to the emitter and an outer surface portion which curves inward relative to the emitter. The outer surface of the emitter can be parallel to the opening surface of the anode. The emitter has a length in a direction substantially orthogonal to the surface of the substrate. The inner portion of the emitter has a length comprising approximately 15 percent to 95 percent of the length of the emitter according to some aspects.

The present invention includes other aspects wherein the emitter includes an inner portion comprising a first doping type semiconductive material and an outer portion comprising a second doping type semiconductive material. For example, the inner portion of the emitter can comprise p-type semiconductive material and the outer portion can comprise n-type semiconductive material.

The present invention also includes methodologies for forming field emission display backplates.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1A:
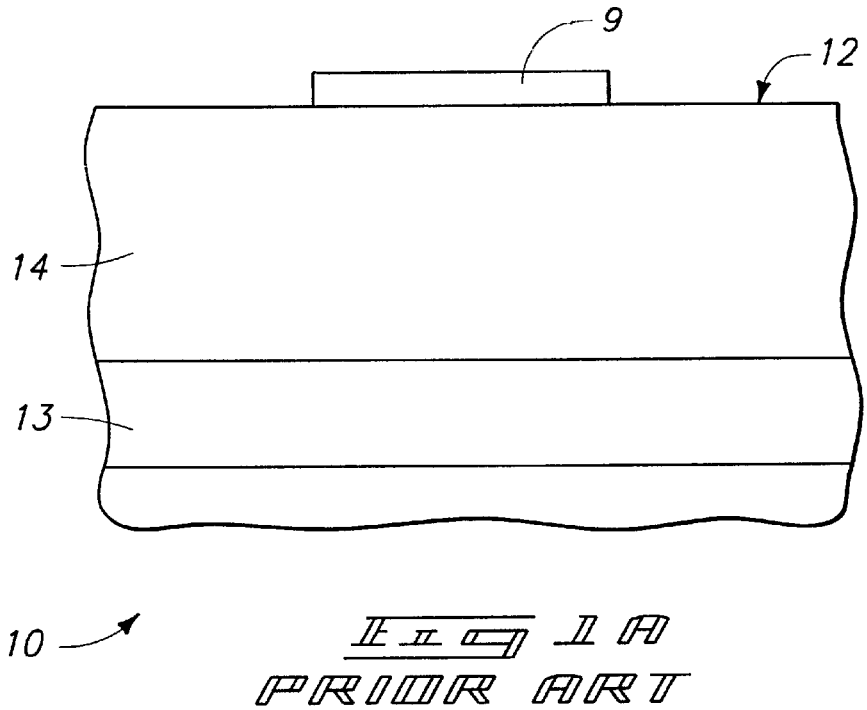
FIG 1A PRIOR ART
FIG. 1*a*–FIG. 1*c* illustrate a process for forming a segment of a conventional field emission display backplate.
Figure 1B:
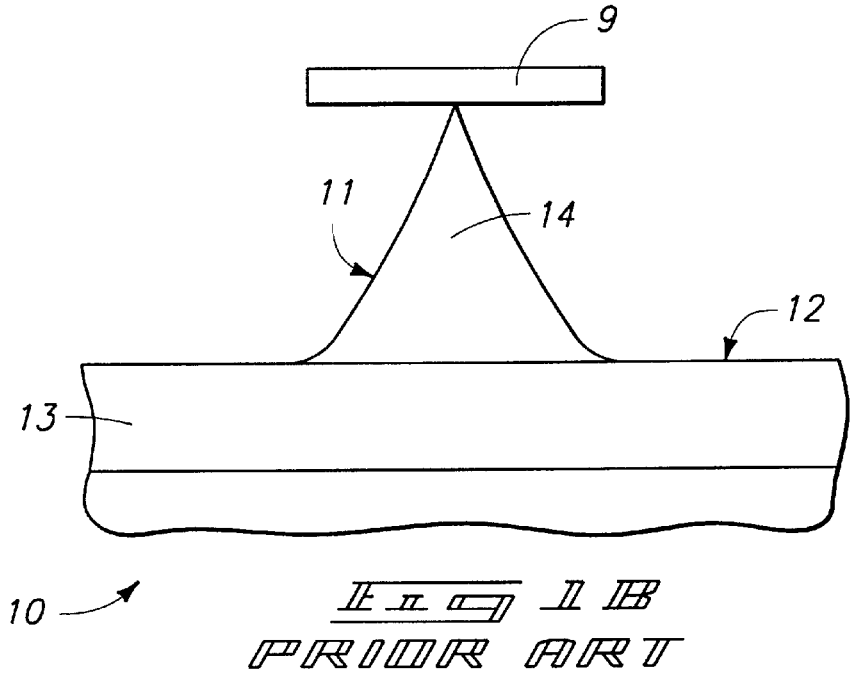
FIG 1B PRIOR ART
Figure 1C:
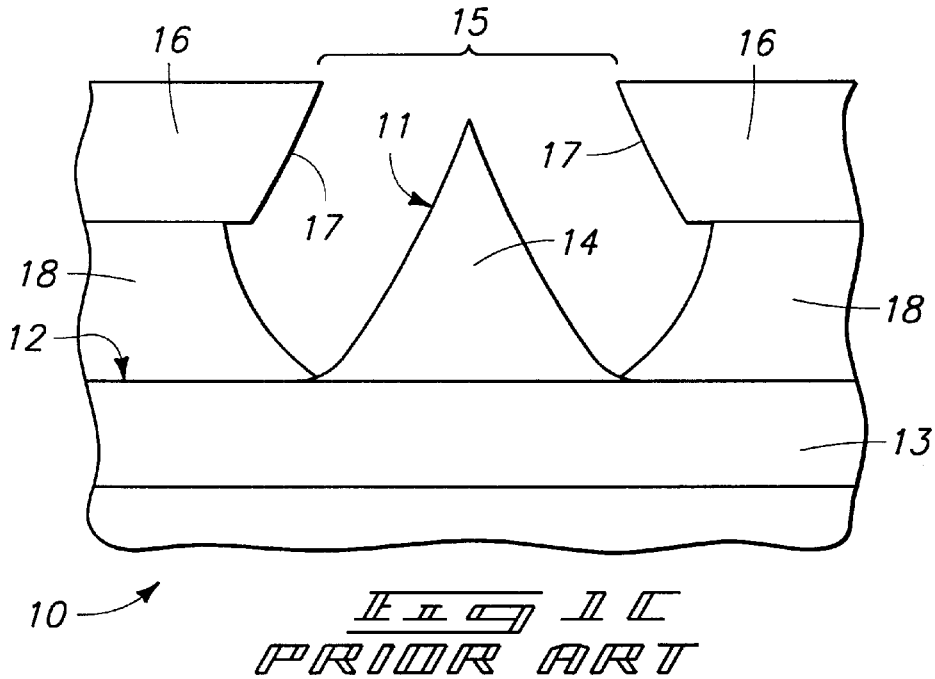
Fig 1C PRIOR ART
Figure 2:
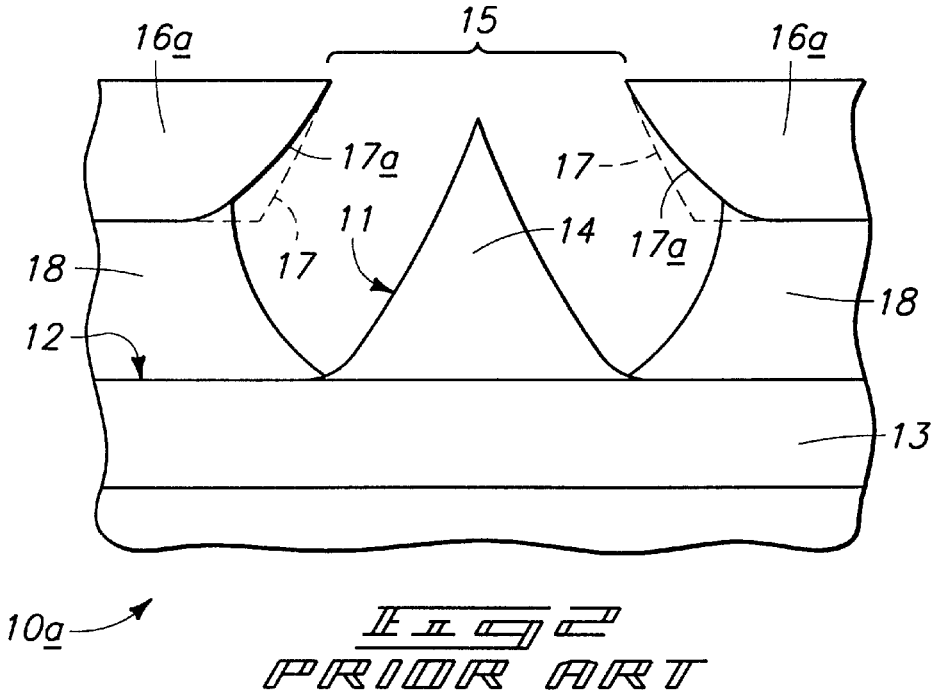
Fig 2 PRIOR ART
FIG. 2 is a cross-sectional side elevational view of a segment of another conventional field emission display backplate.
Figure 3:
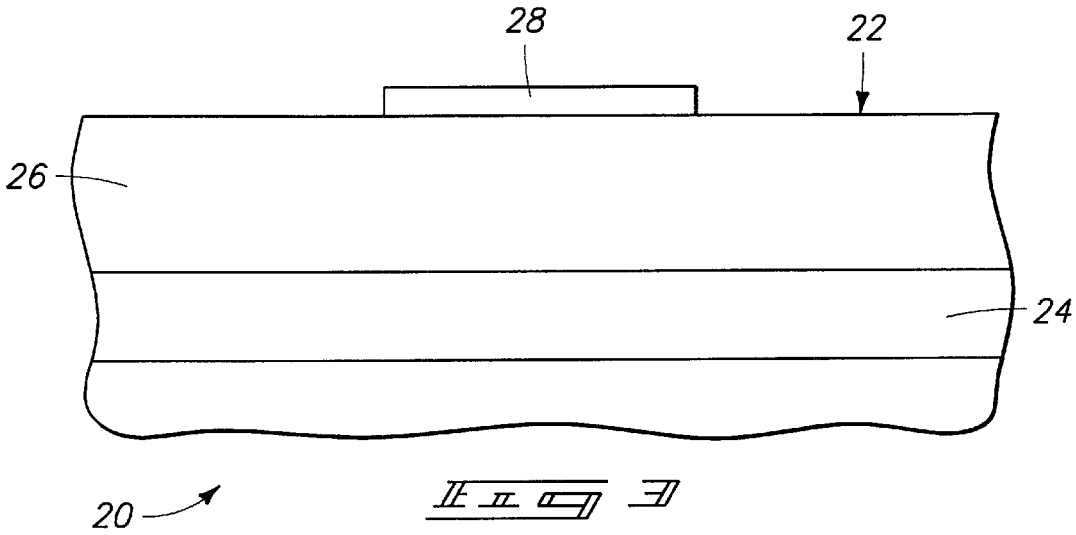
FIG. 3 is a cross-sectional side elevational view of a segment of a backplate comprising a substrate and a mask formed at an initial processing step.

Referring to FIG. 3, a fragment or segment 20 of a field emission display backplate is illustrated at an initial processing step. The depicted field emission display backplate segment 20 includes a bulk substrate 22. Substrate 22 comprises silicon in the described embodiment. For example, substrate 22 can comprise a monocrystalline p-type silicon wafer or polycrystalline silicon or amorphous silicon upon glass.

Substrate 22 includes a first layer comprising a first doping type semiconductive material 24 and a second layer comprising a second doping type semiconductive material 26. In the described fabrication method, first material 24 has been doped with a p-type impurity to provide p− semiconductive material. Second material 26 has been doped with an n-type impurity to provide n+ semiconductive material. A preferred doping concentration of p− semiconductive material 24 is $10^{17}$–$10^{21}/cm^3$. A preferred doping concentration of n+ semiconductive material 26 is $10^{17}$–$10^{21}/cm^3$. Such doping can occur by ion implantation, diffusion or intrinsic doping in exemplary fabrication processes. In but one embodiment, first material 24 has an approximate thickness of 0.5 $\mu$m and second material 26 has an approximate thickness of 1 $\mu$m.

A mask 28 is shown formed over first material 24 and second material 26 and upon substrate 22. Mask 28 is circular and comprises patterned photoresist or $SiO_2$ patterned from such photoresist in the described embodiment. Provision of circular mask 28 forms a field emission display emitter in subsequent processing steps having a generally conical shape as described below. Mask 28 can be formed using conventional photolithographic processing and etching techniques.

Figure 4:
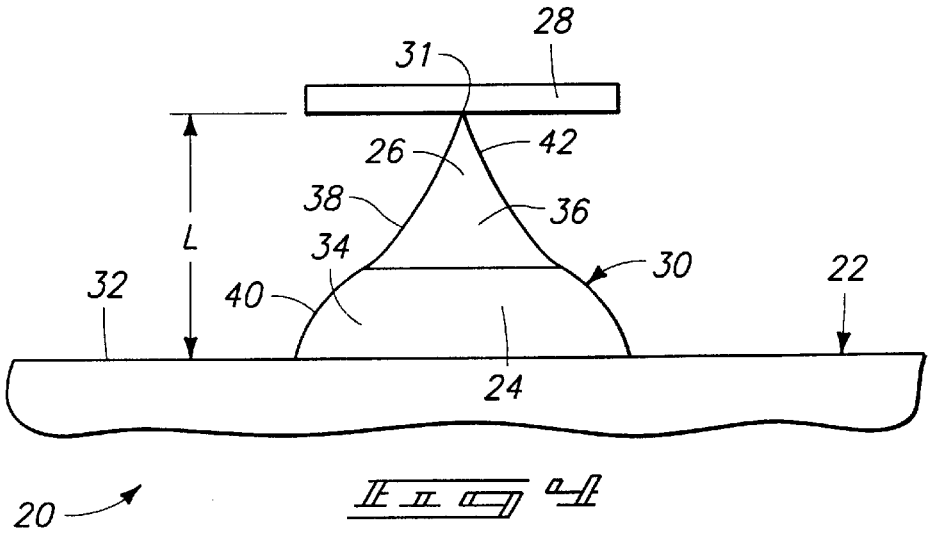
FIG. 4 is a cross-sectional side elevational view of the segment including an emitter formed to extend from the substrate.

Referring to FIG. 4, substrate 22 has been etched to form a field emission display emitter 30. Emitter 30 comprises an apex or tip 31 operable to emit electrons toward a faceplate (not shown). Substrate 22 is preferably isotropically dry etched. An example chemical and etching condition to form the depicted emitter 30 includes a plasma comprising a combination of $NF_3$ and $Cl_2$ and an additive, such as helium. Etching of a portion of first material 24 and second material 26 provides emitter 30 as illustrated. Emitter 30 comprises an inner portion 34 comprising p− semiconductive material 24 and an outer portion 36 comprising n+ semiconductive material 26. Etching of substrate 22 additionally forms a substantially planar surface 32.

The etchant utilized to form emitter 30 is preferably selective to p− semiconductive material 24. However, the etchant is not infinitely selective and some etchback of p− semiconductive material 24 occurs. Etching of the different semiconductive materials 24, 26 occurs at different rates resulting in the structure of emitter 30 depicted in FIG. 4.

Emitter 30 has a surface 38 including an inner surface portion 40 and an outer surface portion 42 corresponding to respective emitter portions 34, 36. Inner surface portion 40 curves outward relative to emitter 30 as a result of the etchback of p− semiconductive material 24 during etching. Outer surface portion 42 curves inward relative to emitter 30. In one embodiment, surface portions 40, 42 of surface 38 individually curve with respect to a respective substantially constant radius. Inner surface portion 40 is convex and outer surface portion 42 is concave in the depicted illustration.

The etching of substrate 22 is preferably timed to provide emitter 30 having desired dimensions. More specifically, emitter 30 extends a length L in a substantially orthogonal direction to surface 32 of substrate 22. In one embodiment, inner portion 34 has a length comprising approximately 15 percent to 95 percent of the length L of emitter 30. Outer portion 36 comprises the remaining length L of emitter 30. Inner portion 34 of emitter 30 preferably has an effective length in a direction substantially orthogonal to substrate surface 32 to reduce the emission of electrons from emitter 30 to an associated grid (shown in FIG. 7). Length L of emitter 30 is within the approximate range of 0.5 $\mu$m to 2 $\mu$m in the described embodiment.

Figure 5:
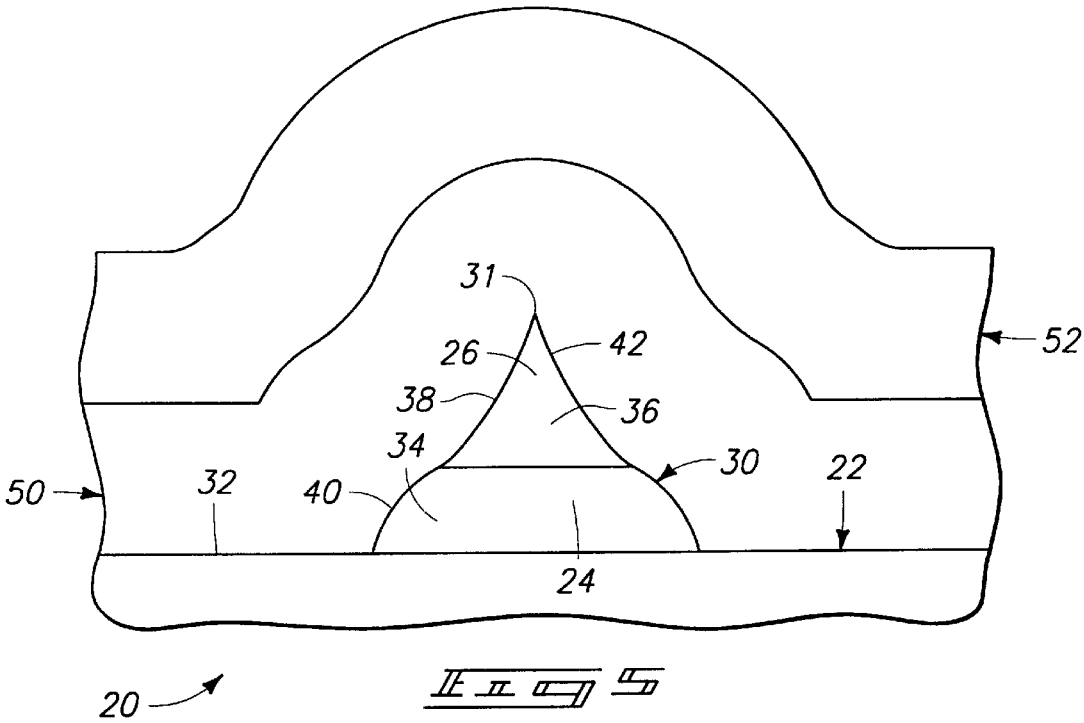
FIG. 5 is a cross-sectional side elevational view of the segment including an insulative layer and conductive layer formed over the emitter of FIG. 4.

Referring to FIG. 5, the photoresist mask has been stripped from emitter 30 and an insulative layer 50 is formed over substrate 22 and emitter 30. An exemplary insulative layer 50 comprises borophosphosilicate glass (BPSG) or silicon oxide ($SiO_2$). BPSG insulative layer 50 may be deposited by chemical vapor deposition (CVD). BPSG insulative layer 50 has a preferred thickness within the approximate range of 0.3 $\mu$m to 1.5 $\mu$m. Thereafter, a conductive layer 52 is formed over insulative layer 50. Conductive layer 52 preferably comprises a metal, doped polysilicon or amorphous silicon. Conductive layer 52 is utilized to form an anodic grid or gate as described below. Conductive layer 52 has a preferred thickness within the approximate range of 0.3 $\mu$m to 0.6 $\mu$m.

Figure 6:
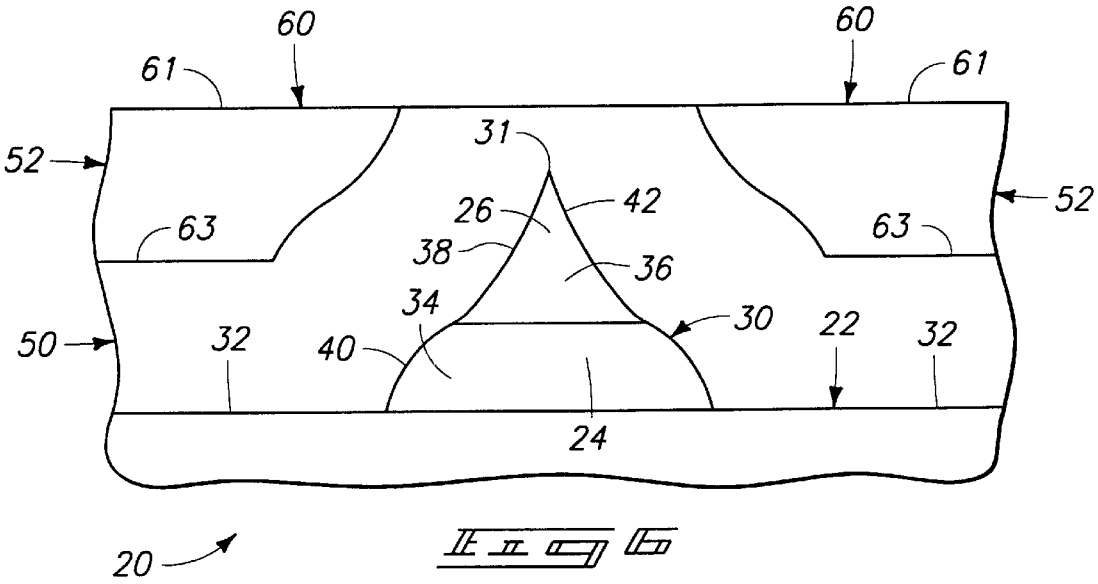
FIG. 6 is a cross-sectional side elevational view of the segment shown in FIG. 5 at a subsequent processing step.

Referring to FIG. 6, field emission display backplate segment 20 has undergone chemical-mechanical polishing to remove portions of insulative layer 50 and conductive layer 52. The chemical-mechanical polishing of field emission display backplate segment 20 exposes insulative layer 50. Chemical-mechanical polishing of field emission display backplate segment 20 provides a substantially planer upper surface which defines an anode 60. Anode 60 may be referred to as a grid or gate and is utilized to control the emission of electrons from corresponding emitter 30. Anode 60 includes an upper surface 61 provided by the chemical-mechanical processing and a lower surface 63 defined by insulative layer 50.

Figure 7:
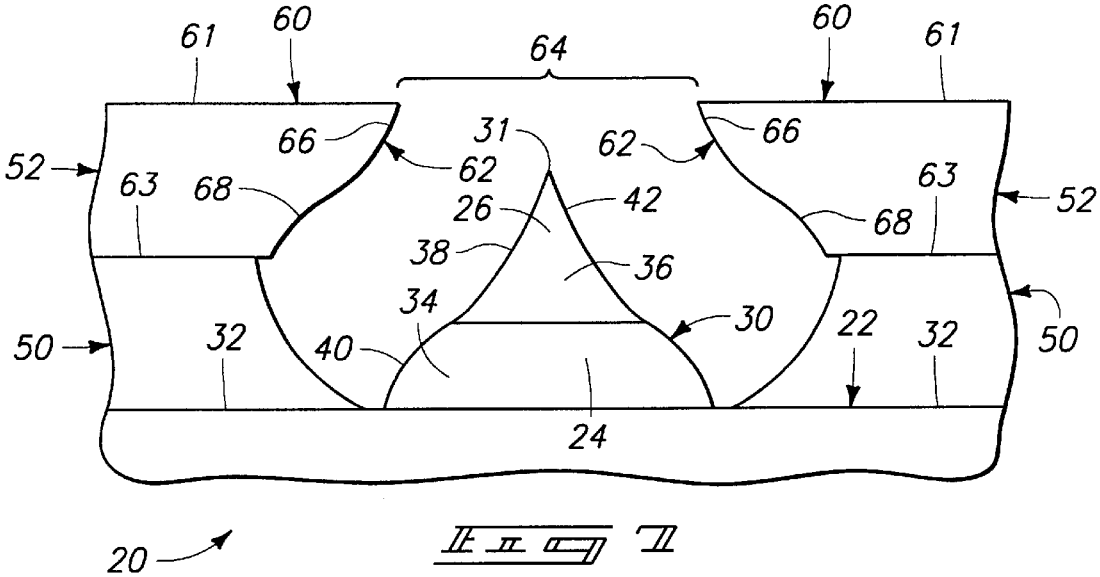
FIG. 7 is a cross-sectional side elevational view of the segment shown in FIG. 6 at a subsequent processing step.

Referring to FIG. 7, wet etching of the field emission display backplate segment 20 depicted in FIG. 6 yields the depicted structure. An exemplary wet etching chemistry includes a buffered oxide etch (BOE). More specifically, a timed etch provides etching of portions of insulative layer 50 adjacent emitter 30 and exposes emitter 30.

As illustrated, anode 60 is spaced from emitter 30 and includes an opening surface 62 which defines a circular opening 64 aligned with emitter 30. Opening surface 62 is a complimentary surface substantially parallel to outer surface 38 of emitter 30. Opening surface 62 is spaced a substantially constant distance from outer surface 38 of emitter 30 in an overlapping region of emitter 30 and anode 60.

More specifically, opening surface 62 includes a first surface portion 66 which curves outward relative to anode 60 and is parallel to surface 42 of emitter outer portion 36. Further, opening surface 62 includes a second surface portion 68 which curves inward relative to anode 60 and is parallel to surface 40 of emitter inner portion 34. In one embodiment, surface portions 66, 68 of opening surface 62 individually curve with respect to a respective substantially constant radius. Accordingly, first surface portion 66 is convex and second surface portion 68 is concave in the depicted illustration.

During operation, a positive voltage bias with reference to substrate 22 is applied to anode 60 resulting in the emission of electrons from emitter 30. It is preferred to minimize the emission of spurious electrons from emitter 30 to anode 60. The field emission display backplate segment 20 depicted in FIG. 7 reduces the emission of such spurious electrons compared with the conventional constructions illustrated above.

More specifically, the structure of FIG. 7 provides a decreased electric field below emitter tip 31. This region of decreased electric field can be tailored, by adjusting the thickness of insulative layer 50, the height of emitter 30 and the thickness of conductive layer 52. In addition, provision of emitter inner portion 34 comprising p-type semiconductive material 24 and having a length of approximately 15 percent to 95 percent of the length of emitter 30 increases the tunnelling barrier providing a structure having less probability of emitting electrons to anode 60.

Further, inasmuch as anode 60 is biased positively with respect to emitter 30, surface 40 of p− semiconductive material 24 of inner portion 34 is depleted of charge carriers creating a space-charge region, also referred to as a depletion region. The space-charge region extends some distance into bulk substrate 22 depending on the doping concentration of p− semiconductive material 24. The creation of this space-charge region results in a reduced electric field at inner be portion 34 of emitter 30. Such reduces the emission of spurious electrons to anode 60.

Additionally, the structure of field emission display backplate segment 20 depicted in FIG. 7 having the space-charge region yields an emitter construction having a total capacitance which is reduced compared to prior art structures. Such reduces the turn-on voltage for emitter 30. Further, the present invention provides a field emission display backplate having an anode opening 64 which is less sensitive to polishing during chemical-mechanical polishing inasmuch as only a portion of anode 60 is pulled back corresponding to surface portions 68.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming a field emission display backplate comprising:

providing a substrate;

forming an emitter over the substrate;

forming an insulative layer over the substrate and the emitter; and forming an anode over the insulative layer having an opening surface which includes a first portion which curves outward relative to the anode and a second portion which curves inward relative to the anode.

2. The method according to claim 1 wherein forming the emitter comprises forming the emitter to have an inner portion including an outward curved surface relative to the emitter and an outer portion including an inward curved surface relative to the emitter.

3. The method according to claim 2, wherein the forming the anode comprises forming the first portion of the opening surface parallel to the inward curved surface of the emitter and the second portion of the opening surface parallel to the outward curved surface of the emitter.

4. The method according to claim 1 wherein the providing comprises:

forming a first layer in the substrate comprising a first doping type semiconductive material; and forming a second layer in the substrate comprising a second doping type semiconductive material.

5. The method according to claim 4 wherein the forming the emitter comprises etching the first layer and the second layer.

6. The method according to claim 1 wherein the providing comprises:

forming a first layer in the substrate comprising p-type semiconductive material; and forming a second layer in the substrate comprising n-type semiconductive material.

7. A method of forming a field emission display backplate comprising:

providing a substrate;

forming a first layer comprising a first doping type semiconductive material;

forming a second layer comprising a second doping type semiconductive material over the first layer;

providing an anode spaced from the substrate; and etching the first layer and second layer to form an emitter comprising the first doping type semiconductive material and the second doping type semiconductive material, and a portion of the emitter comprising the first doping type semiconductive material having a sufficient length in a direction substantially orthogonal to a surface of the substrate to reduce the emission of electrons from the emitter to the anode from that which would occur were such length of first doping type semiconductive material not present;

wherein the anode has a surface contour which substantially parallels a surface contour of the emitter.

8. The method according to claim 7 wherein the etching forms an inner portion comprising the first doping type semiconductive material and having an outward curved surface relative to the emitter and an outer portion comprising the second doping type semiconductive material and having an inward curved surface relative to the emitter.

9. The method according to claim 8 wherein the providing the anode comprises forming an opening surface within the anode having a first portion parallel to the inward curved surface of the emitter and a second portion parallel to the outward curved surface of the emitter.

10. The method according to claim 7 wherein the forming the first layer comprises forming a p-type semiconductive layer and the forming the second layer comprises forming an n-type semiconductive layer.

11. The method according to claim 7 wherein the providing the substrate comprises providing a bulk substrate and the formings individually comprise forming within the bulk substrate.

12. A method of forming a field emission display backplate comprising:

providing a substrate;

etching the substrate to form an emitter including an inner portion having a outward curved surface relative to the emitter and an outer portion having an inward curved surface relative to the emitter; and forming an anode having an opening surface which defines an opening aligned with the emitter and is parallel with the outward curved surface and the inward curved surface of the emitter.

13. The method according to claim 12 further comprising:

forming a first layer within the substrate comprising a first doping type semiconductive material; and forming a second layer within the substrate comprising a second doping type semiconductive material.

14. The method according to claim 13 wherein the etching forms an inner portion comprising the first doping type semiconductive material and an outer portion comprising the second doping type semiconductive material.

15. The method according to claim 14 wherein the forming the first layer comprises forming a p-type semiconductive layer and the forming the second layer comprises forming an n-type semiconductive layer.

16. A method of forming a field emission display backplate comprising:

providing a bulk substrate;

forming a first layer comprising a first doping type semiconductive material within the bulk substrate;

forming a second layer comprising a second doping type semiconductive material over the first layer and within the bulk substrate;

providing an anode spaced from the substrate; and etching the first layer and second layer to form an emitter comprising the first doping type semiconductive material and the second doping type semiconductive material, and a portion of the emitter comprising the first doping type semiconductive material having a sufficient length in a direction substantially orthogonal to a surface of the substrate to reduce the emission of electrons from the emitter to the anode from that which would occur were such length of first doping type semiconductive material not present.

17. The method according to claim 16 wherein the providing the bulk substrate comprises providing a wafer.

18. A method of forming a field emission display backplate comprising:

providing a substrate;

forming a first layer comprising a first doping type semiconductive material;

forming a second layer comprising a second doping type semiconductive material over the first layer;

providing an anode spaced from the substrate; and etching the first layer and second layer to form an emitter comprising the first doping type semiconductive material and the second doping type semiconductive material, and a portion of the emitter comprising the first doping type semiconductive material having a sufficient length in a direction substantially orthogonal to a surface of the substrate to reduce the emission of electrons from the emitter to the anode from that which would occur were such length of first doping type semiconductive material not present;

wherein the etching forms an inner portion comprising the first doping type semiconductive material and having an outward curved surface relative to the emitter and an outer portion comprising the second doping type semiconductive material and having an inward curved surface relative to the emitter.

19. The method according to claim 18 wherein the providing the anode comprises forming an opening surface within the anode having a first portion parallel to the inward curved surface of the emitter and a second portion parallel to the outward curved surface of the emitter.

* * * * *

UNITED STATES PATENT AND TRADEMARK OFFICE

CERTIFICATE OF CORRECTION

PATENT NO. : 6,464,550 B2
DATED : October 15, 2002
INVENTOR(S) : Ji Ung Lee

It is certified that error appears in the above-identified patent and that said Letters Patent is hereby corrected as shown below:

Column 6,
Line 19, please delete “be” after “inner”.

Signed and Sealed this

Third Day of June, 2003

JAMES E. ROGAN
*Director of the United States Patent and Trademark Office*